US008235561B2

(12) United States Patent
Schimmelpfenning et al.

(10) Patent No.: US 8,235,561 B2
(45) Date of Patent: Aug. 7, 2012

(54) LIGHTING FIXTURE WITH COOLING CONDUIT

(75) Inventors: Ron C. Schimmelpfenning, Winona, MN (US); Jonathon S. Wickus, Winona, MN (US)

(73) Assignee: ABL IP Holding LLC, Conyers, GA (US)

( * ) Notice: Subject to any disclaimer, the term of this patent is extended or adjusted under 35 U.S.C. 154(b) by 146 days.

(21) Appl. No.: 12/553,278

(22) Filed: Sep. 3, 2009

(65) Prior Publication Data

US 2011/0051431 A1 Mar. 3, 2011

(51) Int. Cl.
*F21V 31/03* (2006.01)

(52) U.S. Cl. ..... 362/373; 362/218; 362/249.02; 362/267

(58) Field of Classification Search ..... 362/373, 362/218, 217.12, 249.01, 249.02, 267
See application file for complete search history.

(56) References Cited

U.S. PATENT DOCUMENTS

| | | | | |
|---|---|---|---|---|
| 6,732,469 | B2 | 5/2004 | Lindgren | |
| 7,202,613 | B2 * | 4/2007 | Morgan et al. | 315/312 |
| 7,384,165 | B2 * | 6/2008 | Doyle | 362/101 |
| 7,396,139 | B2 | 7/2008 | Savage | |
| 7,575,333 | B2 * | 8/2009 | Julia Vilarrasa | 362/101 |
| 7,686,469 | B2 | 3/2010 | Ruud et al. | |
| 7,744,236 | B2 * | 6/2010 | Hsu et al. | 362/101 |
| 7,855,492 | B2 * | 12/2010 | Schiene et al. | 313/32 |
| 2002/0114155 | A1 * | 8/2002 | Katogi et al. | 362/219 |
| 2006/0176686 | A1 * | 8/2006 | McVicker | 362/183 |
| 2006/0187652 | A1 * | 8/2006 | Doyle | 362/96 |
| 2007/0230194 | A1 * | 10/2007 | Julia Vilarrasa | 362/373 |
| 2007/0268702 | A1 * | 11/2007 | McFadden | 362/294 |
| 2008/0089071 | A1 * | 4/2008 | Wang | 362/294 |
| 2008/0123351 | A1 * | 5/2008 | Olsson | 362/335 |

OTHER PUBLICATIONS

'Waterguard Plus—Flourescent Waterproof Lighting' [online]. EncapSulite, Apr. 15, 2008 [retrieved on Mar. 23, 2010]. Retrieved from the Internet: <URL: http://web.archive.org/web/20080415063038/www.encapsulite.com/waterguard.html>.

'Waterguard Plus' [online]. EncapSulite, [retrieved on Mar. 23, 2010]. Retrieved from the Internet: <URL: http://www.encapsulite.com/documents/waterguard%20brochure%20web.pdf>.

"Xtreme Tube Installation Manual Doc No. 710-000-187," *Lighting Science*, 2008, 9 pages.

"Xtreme Tube Doc No. 710-000-187," *Lighting Science*, 2010, 3 pages.

* cited by examiner

*Primary Examiner* — Robert May
*Assistant Examiner* — Leah S Macchiarolo
(74) *Attorney, Agent, or Firm* — Kilpatrick Townsend & Stockton LLP

(57) ABSTRACT

Among other disclosed subject matter, a lighting device cooled by being at least partially submerged is provided. The lighting device includes a housing forming a chamber having at least one transparent portion. The lighting device includes a diode in the chamber emitting light through the transparent portion. The lighting device includes a cooling conduit configured for a liquid to flow along the chamber when the lighting device is at least partially submerged in the liquid, without the liquid contacting the diode. The diode is mounted on a surface that abuts the cooling conduit.

13 Claims, 6 Drawing Sheets

LIGHTING FIXTURE WITH COOLING CONDUIT

TECHNICAL FIELD

This document relates to a lighting fixture having a cooling conduit for a liquid.

BACKGROUND

Lighting fixtures are designed for use in one or more environments. For example, some fixtures are limited to indoor use, while others can also be used outdoors or even under water. Generally, a water resistant or water proof fixture will have an enclosed configuration that prevents water or moisture from reaching the light elements or other circuitry.

One form of light source is a light-emitting diode (LED). LEDs are characterized by ample and reliable light emission from a relatively small physical device. However, LEDs also generate substantial heat when in operation, and unless properly dissipated, this energy can in some situations cause the LED, or materials nearby, to be damaged or destroyed.

SUMMARY

The invention relates to a lighting fixture having a cooling conduit.

In a first aspect, a lighting device cooled by being at least partially submerged is provided. The lighting device includes a housing forming a chamber having at least one transparent portion. The lighting device includes a diode in the chamber emitting light through the transparent portion. The lighting device includes a cooling conduit configured for a liquid to flow along the chamber when the lighting device is at least partially submerged in the liquid, without the liquid contacting the diode. The diode is mounted on a surface that abuts the cooling conduit.

Implementations can include any or all of the following features. The cooling conduit can extend at least partially inside the chamber. The housing can have an essentially circular cross section between first and second ends. The chamber can be sealed against the liquid using essentially cylindrical end brackets at the first and second ends. Each of the end brackets can include at least first and second parts clamping a gasket radially outward against an interior surface of the housing around an entire circumference of the end bracket. The first and second parts can form an essentially v-shaped groove facing the interior surface around the entire circumference, wherein the gasket is clamped against the interior surface upon one of the first and second parts being biased toward the other. The gasket can have a cross-section that is essentially v-shaped and fits the v-shaped groove. The cooling conduit can extend inside the chamber between openings in the end brackets. The diode can be mounted on a generally flat surface that forms part of the cooling conduit. The cooling conduit can have a generally semi-circular cross section formed by the flat surface and a curved surface. The conduit can be formed by a conduit housing and the chamber can be formed by attaching the housing and the conduit housing together. At least one row of diodes can be mounted inside the housing along the chamber essentially in a flow direction of the liquid. The cooling conduit can be longitudinally divided by a baffle extending between first and second ends of the cooling conduit, the baffle forming at least a first channel that abuts the chamber and a second channel that does not abut the chamber, the baffle having at least one opening between the first and second ends that connects the first and second channels.

In a second aspect, a submersible light fixture includes a transparent housing that is generally cylindrical and that forms a waterproof chamber between first and second brackets at respective ends of the transparent housing. The submersible light fixture includes a conduit housing enclosed in the transparent housing and extending between openings in the first and second brackets, the conduit housing forming a cooling conduit through the waterproof chamber for a liquid entering at least one of the openings upon the light fixture being submersed in the liquid. The submersible light fixture includes at least one row of light-emitting diodes mounted inside the waterproof chamber on an outside surface of the conduit housing, wherein the liquid in the cooling conduit cools an opposite side of the outside surface without contacting the light-emitting diodes.

Implementations can include any or all of the following features. The cooling conduit can have a cross-section with at least one substantially flat surface, and the row of light-emitting diodes can be mounted on the substantially flat surface. The cooling conduit can be longitudinally divided by a baffle extending between the first and second brackets, the baffle forming a first channel that abuts the substantially flat surface and a second channel that does not abut the substantially flat surface, the baffle having at least one opening between the first and second brackets that connects the first and second channels.

The details of one or more implementations are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

Figure 1:
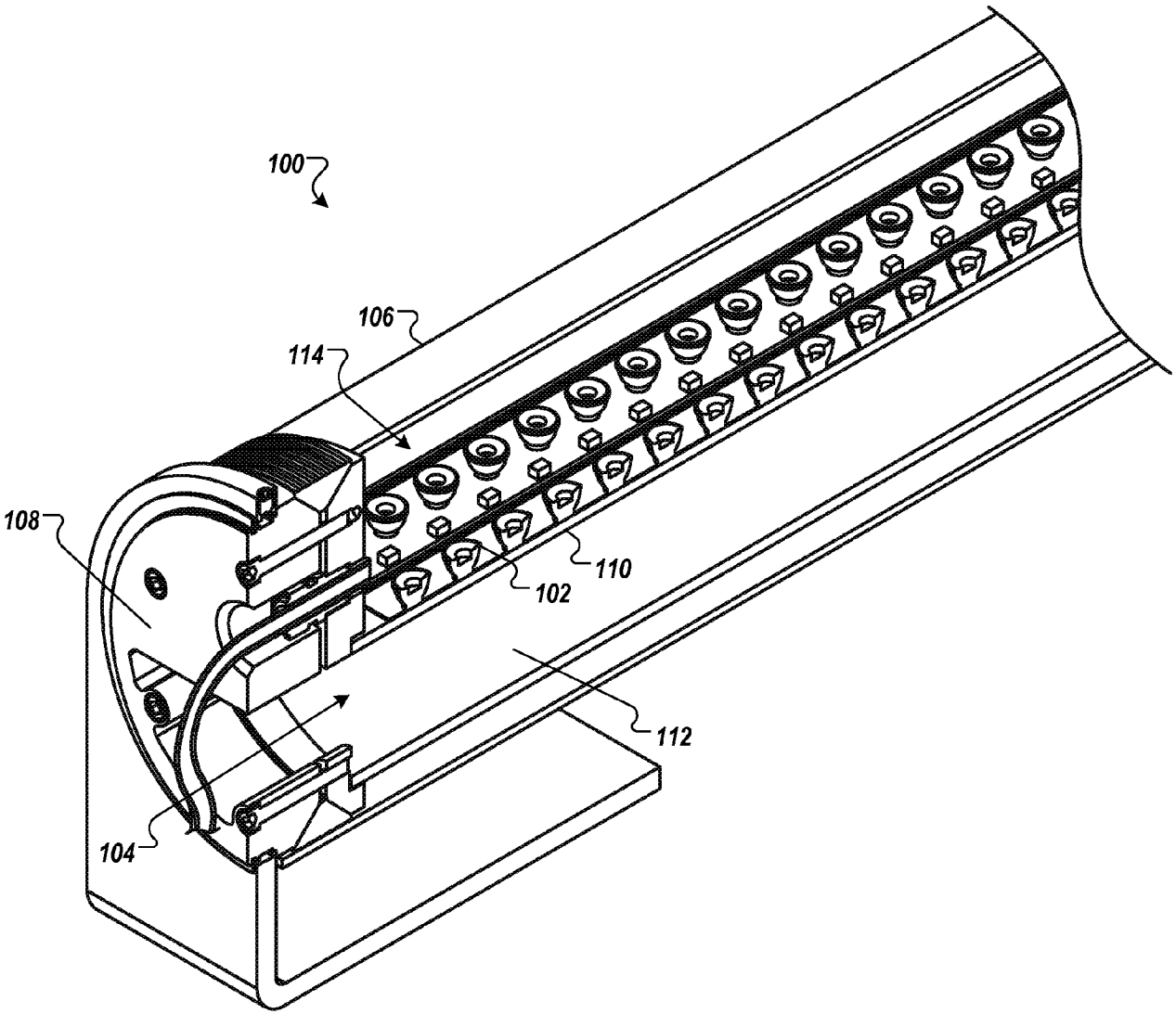
FIG. 1 is a diagram of an example lighting fixture.

FIG. 1 is a diagram of an example lighting fixture 100. The lighting fixture 100, in this example contains diodes 102, a cooling conduit 104, a housing 106, and end brackets 108. The example lighting fixture 100 can be used to, for example, illuminate a liquid environment such as a fountain, pool, aquarium, hot tub, or beach. Such illumination can be used for decorative purposes, to illuminate a work area such as for underwater welding, for safety purposes such as to demarcate a shallow end and deep end of a pool, or for other purposes. Particularly, the cooling conduit 104 can provide useful cooling of the lighting fixture by allowing a liquid such as water to contact parts of the fixture that are exposed to significant heat.

In some embodiments, illumination can be accomplished by diodes such as the light emitting diodes (LEDs) 102. LEDs 102 can include any or all of a variety of components that emit light when an external voltage is applied to the junction of a P-type and N-type semiconductor. In these embodiments, the LEDs 102 can produce significant heat and may be cooled.

The LEDs 102 can be mounted on a surface 110 which can be a flat surface. In some examples, the surface 102 is a flat surface of greater length in one dimension than another, which is to say the surface is longer than it is wide. In this example, LEDs 102 can be positioned in one or more rows along the longer dimension.

In some embodiments, the surface 110 can abut the cooling conduit 104, which can be a conduit that to be filled with a surrounding liquid. For example, if the lighting fixture 100 is installed in a large fountain, the fountain water can fill and/or flow through the conduit 104 and cool the fixture from heat generated by the LEDs 102. The cooling conduit 104 can partly be formed by a conduit housing 112 and can be terminated on one or both ends of the lighting fixture 100 by the end bracket 108. The conduit housing can be made of a rigid or semi-rigid material suitable for a moist or liquid environment, such as extruded plastics or metal.

The housing 106 can surround the LEDs 102, the surface 110, and/or the conduit housing 112. Some or all of the housing can be transparent or near-transparent, for example, to allow light generated by the LEDs to emerge from the fixture. By affixing the conduit housing 112 and the housing 106 to the end brackets 108, a chamber 114 can be created. The chamber 114 can contain the LEDs 102 and can be protected from the liquid environment.

Accordingly, the example lighting fixture 100 can provide a liquid-proof environment for the LEDs 102 while allowing surrounding liquid to absorb heat generated by the LEDs. This facilitates that LEDs can be used that without the liquid-cooling effect would generate too much heat for the installation. As another example, it can allow more LEDs to be used in the fixture than possible without the cooling.

Figure 2:
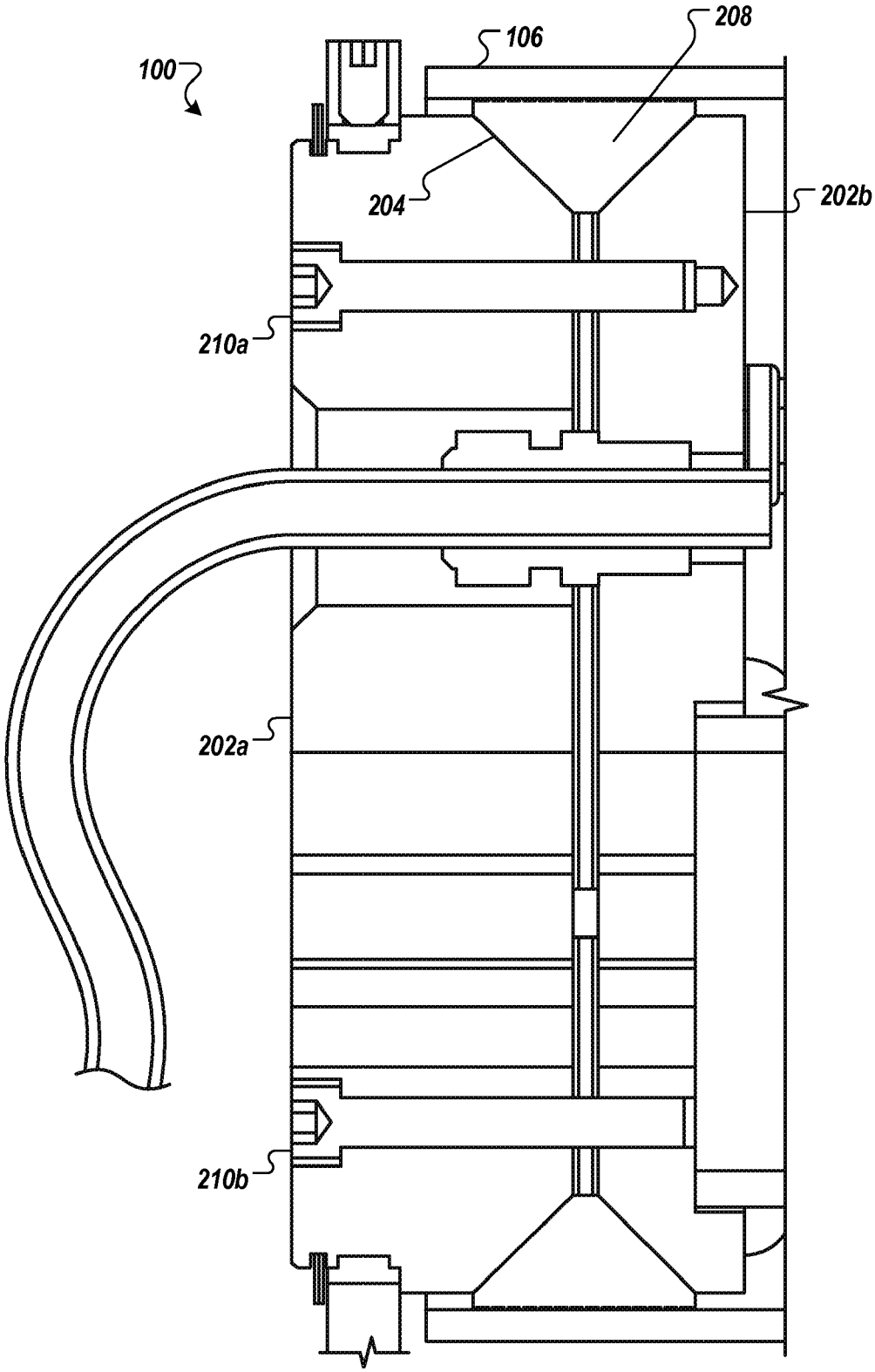
FIG. 2 is a partial side section view of an example lighting fixture.

FIG. 2 is a partial side section view of the example lighting fixture 100. The lighting fixture 100 can be sealed from surrounding liquid and moisture by an end bracket 202. The end bracket 202 can be made of any material, such as metal or plastic, which is suitable to extended exposure to wet environments. In some embodiments, the end brackets 202 can be cylindrical in shape. In some embodiments, the end bracket 202 can include of two end bracket sections 202*a* and 202*b* which can be held together by one or more screws 210.

In some embodiments, the end bracket 202 can form a groove 204 around its circumference. The groove 204 can be formed between two sections 210*a* and 210*b* of the end bracket 210. The groove 204 can have any shape, such as a V shape in which the widest section of the groove extends parallel with the outside surface of the end bracket 210.

A gasket 208 can be clamped to seal against the interior of the housing 106. In some implementations, the gasket 208 can be made of any deformable material, such as rubber, silicon or polymer plastic, suitable to extended exposure to wet environments In some implementations, the gasket 208 can be covered with an adhesive or sealing substance, such as silicone or gasket conditioner, to ensure a more efficient seal. The gasket 208 is suitable for being made by production techniques such as injection molding. The gasket 208 can have a V cross-sectional shape and fit in the groove 204. In some embodiments, one or more screws 210 can be used to pull the end bracket sections 202*a* and 202*b* together, biasing the gasket 204 toward the housing 106. This bias can radially seal the gasket 204 against the interior of the housing 106.

Figure 3A:
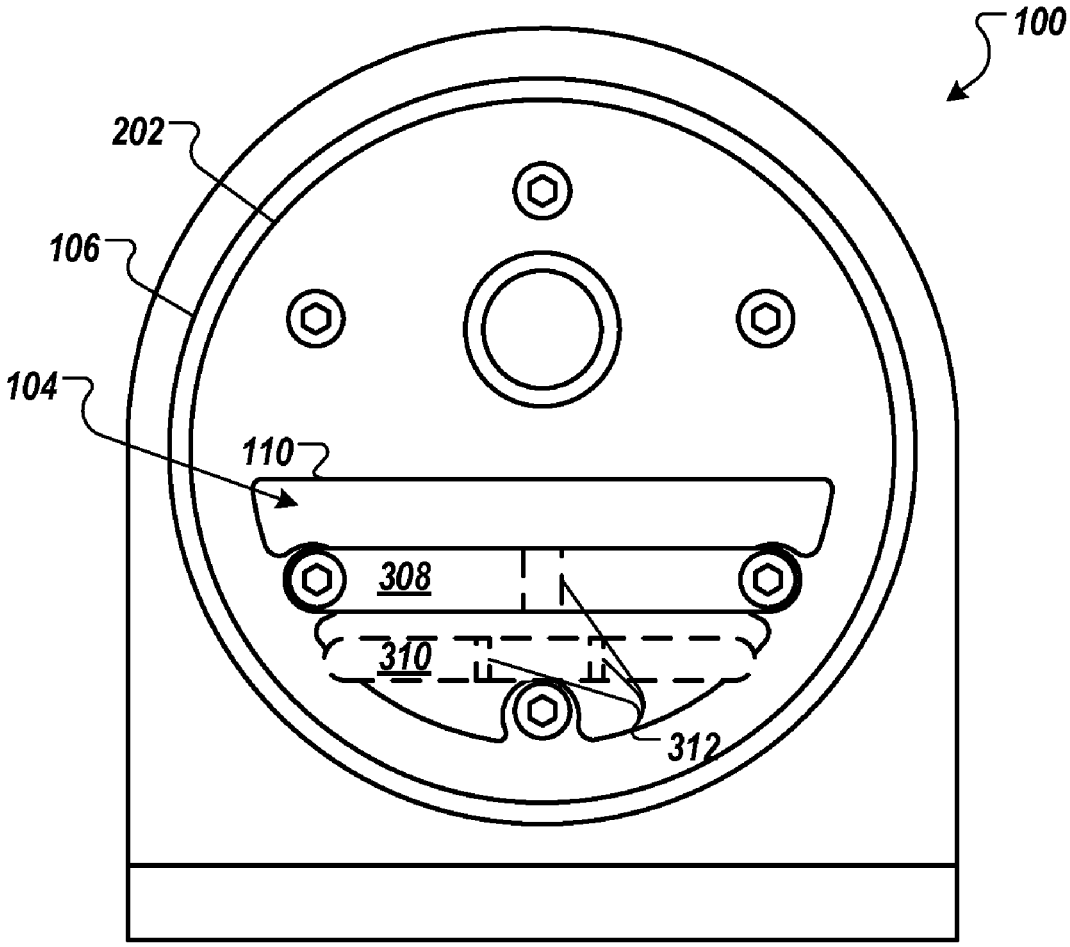
FIG. 3A is a side end view of an example lighting fixture.

FIG. 3A is a side end view of an example lighting fixture 100. In this view, the end bracket 202, housing 106, and cooling channel 104 are illustrated. In this example, the housing 106 has a circular cross section that fits around the end bracket 202. The end bracket 202 includes at least one opening to the cooling channel 104. The opening(s) allow a liquid to enter and/or flow through the cooling channel 104. The cooling channel 104 can have a semi-circular cross section with a flat surface and a curved surface. In this example, the curved surface can describe a circular arc with the same center point as the circumference around the end bracket 202.

In some embodiments, multiple channels can be formed within the cooling conduit 104. A baffle 308, or multiple baffles such as baffles 308 and 310, can be affixed inside the cooling conduit. In some embodiments, the baffles 308 and 310 can extend for the entire length of the cooling conduit. In some embodiments, the baffles 308 and 310 can create one or more channels that do not abut the surface 110. One or more passages 312 can be formed in the baffle 308 and/or 310, for example as openings between the channels that can allow liquid to pass through. In some implementations, this can allow for more efficient liquid flow and/or cooling than in embodiments without the baffles 308 and/or 310.

Figure 3B:
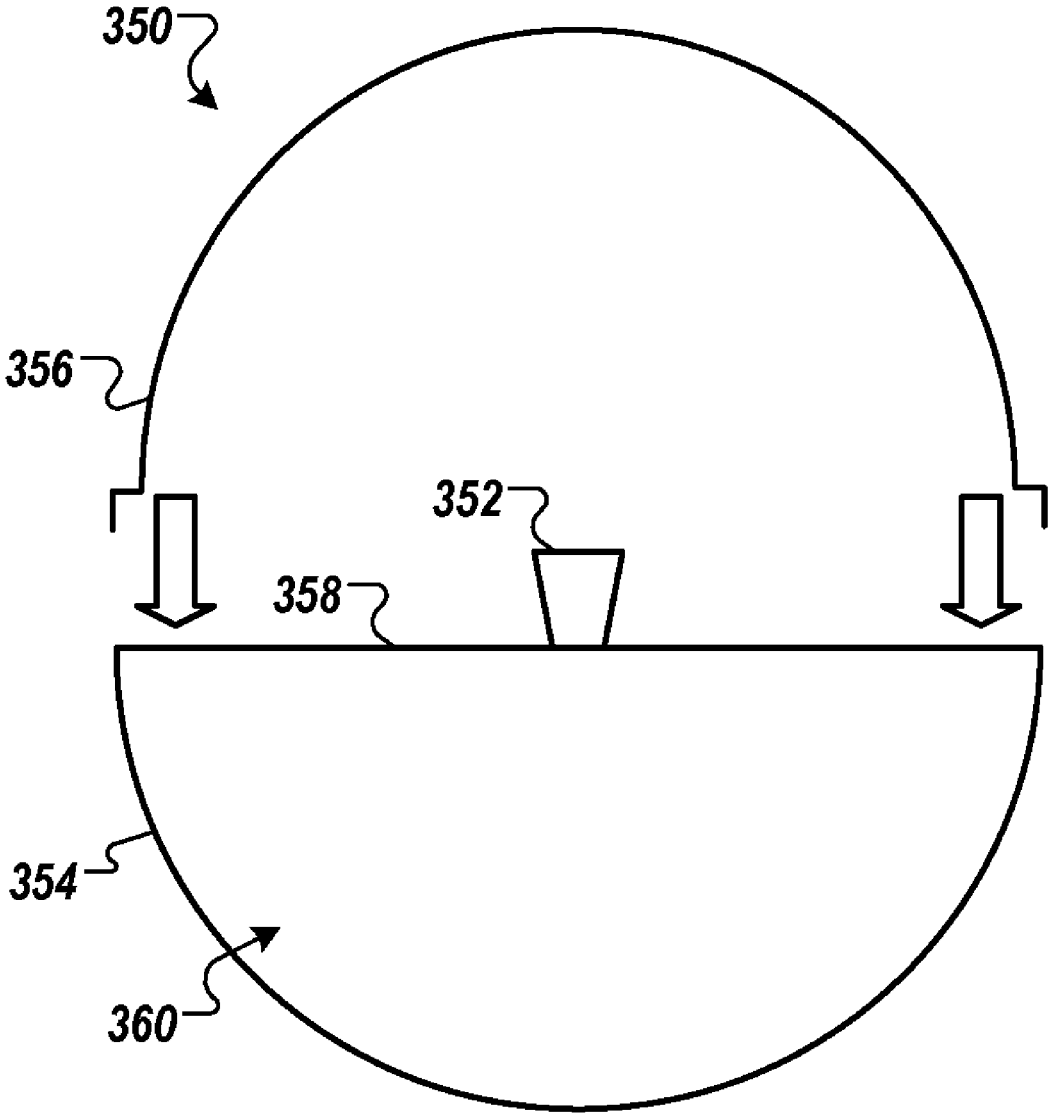
FIG. 3B is a side end view of an example lighting fixture.

FIG. 3B is a side end view of another example lighting fixture 350. The example lighting fixture 350 illustrates an embodiment with another structure and configuration of components. The lighting fixture 350 includes housing 356, a diode 352 which can emit light, and a cooling conduit housing 354. The cooling conduit housing 354 can form a cooling conduit 358, which can allow fluid to pass and can cool the diode 352. The diode 352 can be mounted on a surface 356, which can abut the cooling conduit 358.

In this example, the housing 356 is shown removed from the cooling conduit housing 354. If the housing 356 is lowered and affixed to the cooling conduit housing 354, a chamber can be created inside the housing. In the chamber, the diode 352 can be separated from surrounding liquid if the lighting fixture 350 is partially or wholly submerged in a liquid.

Figure 3C:
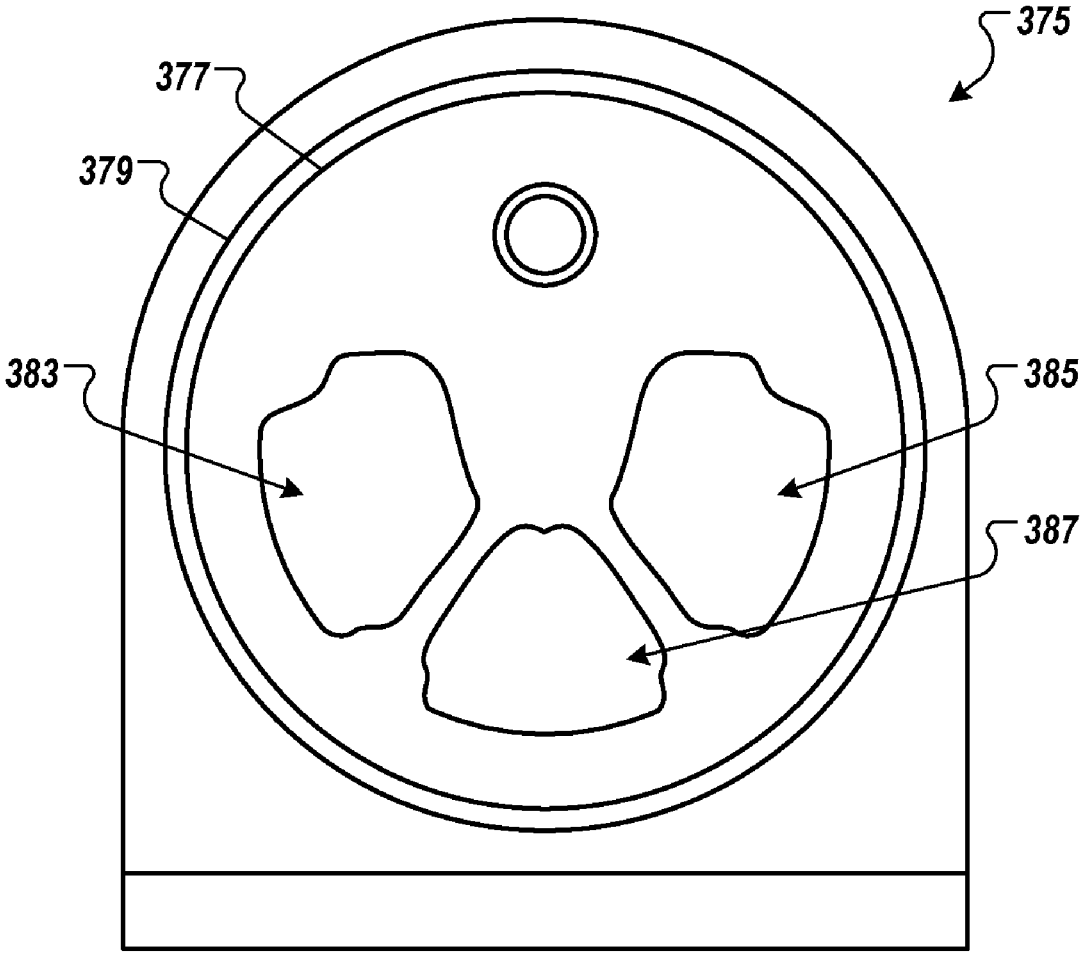
FIG. 3C is a side end view of another example lighting fixture.

FIG. 3C is a side end view of another example lighting fixture 375. The lighting fixture 375 illustrates an embodiment with an end bracket 377 having three openings 383, 385, and 387 through it. In this example, a housing 379 has a circular cross section that fits around the end bracket 377. The three openings 383, 385, and 387 can allow surrounding liquid to enter a core cooling conduit. The end bracket 377 can be fitted at one end of the lighting fixture 375 and a corresponding bracket at the other end, allowing liquid to pass through a cooling conduit. Here, the housing 379 is essentially hollow, forming a single cooling conduit that extends between the end brackets.

Figure 4B:
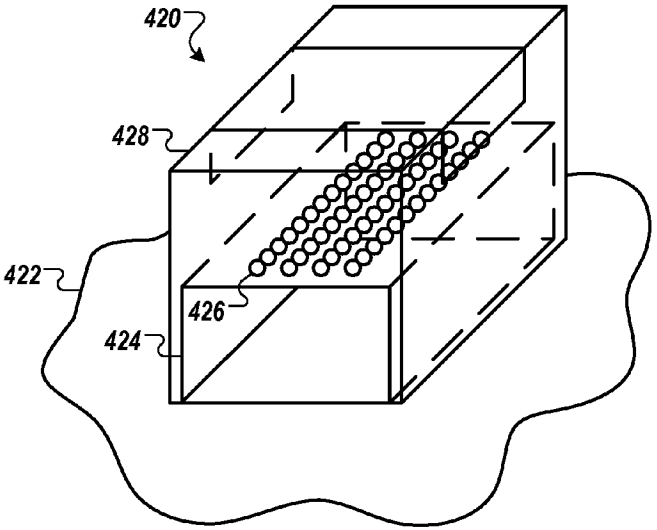
FIG. 4B is a diagram of an example lighting fixture with a rectangular cross-section.
Figure 4D:
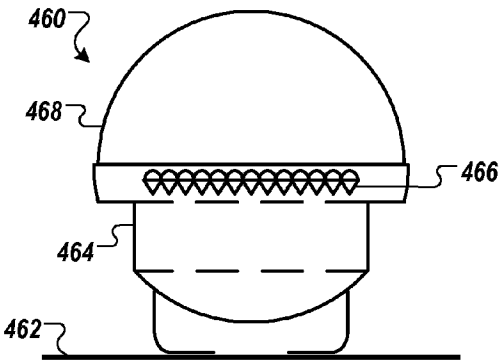
FIG. 4D is a diagram of an example lighting fixture that can be rotated to align with fluid currents.
Figure 4A:
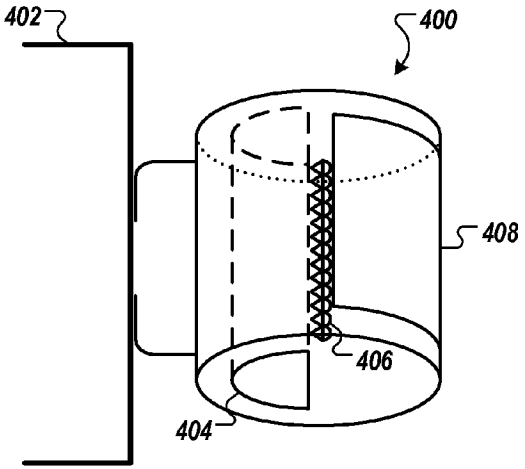
FIG. 4A is a diagram of an example lighting fixture mounted on a vertical wall.

FIG. 4A is a diagram of an example lighting fixture 400 mounted on a vertical wall 402. The lighting fixture 400 has a cooling channel 404, LEDs 406, and a housing 408 that are aligned generally vertically and generally parallel to the vertical wall 402. The lighting fixture 400 and wall 402 can be in a liquid environment, such as under water in a swimming pool.

In some embodiments, the lighting fixture 400 can be generally the same lighting fixture as the lighting fixture 100. In other embodiments, the lighting fixture 400 can differ from the lighting fixture 100, such as by having more or fewer LEDs 406, a different shape cooling channel 404, and/or in other ways.

FIG. 4B is a diagram of an example lighting fixture with a rectangular cross-section. The lighting fixture 420 can have a cooling channel 424, LEDs 426, and a housing 428. The lighting fixture 420 can be mounted on a surface 422 and be fully or partially submersed in a liquid environment, such as on any surface of a fountain, or on a boat or other marine vehicle.

Figure 4C:
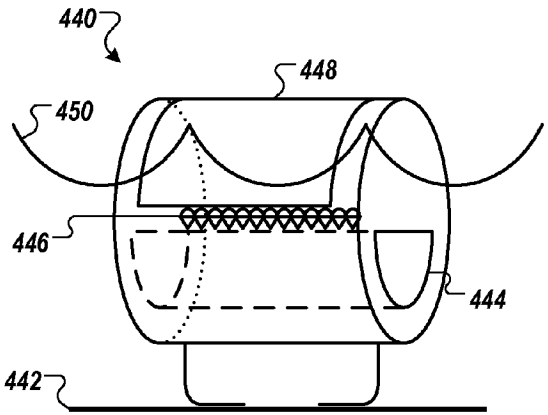
FIG. 4C is a diagram of an example semi-submersed lighting fixture.

FIG. 4C is a diagram of an example semi-submersed lighting fixture. The lighting fixture 440 can have a cooling channel 444, LEDs 446, and a housing 448. The lighting fixture 440 can be mounted on a surface 442. A liquid 450, such as water, can surround some or all of the lighting fixture 440. The surface of the liquid 450 can fluctuate, for example because of waves, ripples, or a raising or lowering of the overall surface. In some examples, the some or all of the housing 448 can be partially or wholly transparent. As the surface 440 fluctuates, some or all of the transparent section of 448 can be submerged in the liquid 450.

In some embodiments, the lighting fixture 440 can be generally the same lighting fixture as the lighting fixture 100. In other embodiments, the lighting fixture 440 can differ from the lighting fixture 100, such as by having more or fewer LEDs 446, a different shape cooling channel 444, and/or in other ways.

FIG. 4D is a diagram of an example lighting fixture 460 that can be rotated to align with fluid currents. The lighting fixture 460 can have a cooling channel 464, LEDs 466, and a housing 464. The lighting fixture 460 can be mounted on a surface 462 and in a liquid environment, such as on a beach, in a wave pool, or hot tub. Some liquid environments have regular movements, such as waves and/or convection currents. The lighting fixture 460 can be rotated or positioned so that the cooling channel 464 and LEDs 466 align with some or all of the liquid movements. For example, a reflecting pool may have an impeller driven current that circles the pool to prevent growth of bacteria or algae. The lighting fixture 460 can be rotated about it's base 470 so that the cooling channel 464 and LEDs 466 align with the current. In some examples, the current can increase the movement of liquid through the cooling channel, which can increase the amount of cooling provided to the lighting fixture 460.

A number of implementations have been described. Nevertheless, it will be understood that various modifications may be made without departing from the spirit and scope of this disclosure. Accordingly, other implementations are within the scope of the following claims.

What is claimed is:

1. A lighting device cooled by being at least partially submerged, the lighting device comprising:

a housing forming a chamber having at least one transparent portion;

a diode in the chamber emitting light through the transparent portion; and a cooling conduit configured for a liquid to flow along the chamber when the lighting device is at least partially submerged in the liquid, without the liquid contacting the diode, wherein the diode is mounted on a first surface that abuts the cooling conduit;

wherein the cooling conduit is longitudinally divided by a baffle extending between first and second ends of the cooling conduit, the baffle forming at least a first channel that abuts the first surface and a second channel that does not abut the first surface, the baffle having at least one opening between the first and second ends that connects the first and second channels.

2. The lighting device of claim 1, wherein the cooling conduit extends at least partially inside the chamber.

3. The lighting device of claim 1, wherein the housing has an essentially circular cross section between first and second ends.

4. The lighting device of claim 3, wherein the chamber is sealed against the liquid using essentially cylindrical end brackets at the first and second ends.

5. The lighting device of claim 4, wherein each of the end brackets comprises at least first and second parts clamping a gasket radially outward against an interior surface of the housing around an entire circumference of the end bracket.

6. The lighting device of claim 5, wherein the first and second parts form an essentially v-shaped groove facing the interior surface around the entire circumference, wherein the gasket is clamped against the interior surface upon one of the first and second parts being biased toward the other.

7. The lighting device of claim 6, wherein the gasket has a cross-section that is essentially v-shaped and fits the v-shaped groove.

8. The lighting device of claim 4, wherein the cooling conduit extends inside the chamber between openings in the end brackets.

9. The lighting device of claim 1, wherein the first surface is generally flat.

10. The lighting device of claim 9, wherein the cooling conduit has a generally semi-circular cross section formed by the first surface and a curved surface.

11. The lighting device of claim 1, wherein the conduit is formed by a conduit housing and wherein the chamber is formed by attaching the housing and the conduit housing together.

12. The lighting device of claim 1, wherein at least one row of diodes is mounted inside the housing along the chamber essentially in a flow direction of the liquid.

13. A submersible light fixture comprising:

a transparent housing that is generally cylindrical and that forms a waterproof chamber between first and second brackets at respective ends of the transparent housing;

a conduit housing enclosed in the transparent housing and extending between openings in the first and second brackets, the conduit housing forming a cooling conduit through the waterproof chamber for a liquid entering at least one of the openings upon the light fixture being submersed in the liquid; and at least one row of light-emitting diodes mounted inside the waterproof chamber on an outside surface of the conduit housing, wherein the liquid in the cooling conduit cools an opposite side of the outside surface without contacting the light-emitting diodes;

wherein the outside surface of the conduit housing is substantially flat, and wherein the cooling conduit is longitudinally divided by a baffle extending between the first and second brackets, the baffle forming a first channel that abuts the outside surface and a second channel that does not abut the outside surface, the baffle having at least one opening between the first and second brackets that connects the first and second channels.

* * * * *